US006571512B1

(12) United States Patent
Miller et al.

(10) Patent No.: US 6,571,512 B1
(45) Date of Patent: Jun. 3, 2003

(54) UNIVERSAL SENSING EDGE WITH NON-MELT END CLOSURE

(75) Inventors: Bearge D. Miller, West Grove, PA (US); Gary Leigh, Kennett Square, PA (US); Jack Klebon, Phoenixville, PA (US); Timothy Castello, West Chester, PA (US)

(73) Assignee: Miller Edge, Inc., West Grove, PA (US)

( * ) Notice: Subject to any disclaimer, the term of this patent is extended or adjusted under 35 U.S.C. 154(b) by 0 days.

(21) Appl. No.: 10/132,097

(22) Filed: Apr. 24, 2002

(51) Int. Cl.[7] ..... E05F 15/02
(52) U.S. Cl. ..... 49/27
(58) Field of Search ..... 49/26, 27, 28, 49/197; 200/61.43

(56) References Cited

U.S. PATENT DOCUMENTS

| | | | | | |
|---|---|---|---|---|---|
| 3,133,167 | A | | 5/1964 | Miller | |
| 3,855,733 | A | | 12/1974 | Miller | |
| 4,019,004 | A | * | 4/1977 | Gute | 200/61.43 |
| 4,396,814 | A | | 8/1983 | Miller | |
| 4,785,143 | A | | 11/1988 | Miller | |
| 4,908,483 | A | | 3/1990 | Miller | |
| 4,954,673 | A | | 9/1990 | Miller | |
| 4,972,054 | A | | 11/1990 | Miller et al. | |
| 5,023,411 | A | | 6/1991 | Miller et al. | |
| 5,027,552 | A | * | 7/1991 | Miller et al. | 49/27 |
| 5,079,417 | A | | 1/1992 | Strand | |
| 5,087,799 | A | | 2/1992 | Pariot et al. | |
| 5,192,837 | A | | 3/1993 | Chardon | |
| 5,225,640 | A | | 7/1993 | Miller et al. | |
| 5,260,529 | A | | 11/1993 | Miller | |
| 5,345,671 | A | | 9/1994 | Miller | |
| 5,418,342 | A | | 5/1995 | Miller | |
| 5,438,798 | A | * | 8/1995 | Plamper et al. | 49/28 |
| 5,728,984 | A | | 3/1998 | Miller | |
| 5,839,227 | A | * | 11/1998 | Gardner | 49/27 |
| 5,921,026 | A | * | 7/1999 | Miller | 49/27 |
| 5,962,825 | A | | 10/1999 | Miller | |

FOREIGN PATENT DOCUMENTS

| | | |
|---|---|---|
| CA | 1 174 902 | 9/1984 |

* cited by examiner

*Primary Examiner*—Jerry Redman
(74) *Attorney, Agent, or Firm*—Akin, Gump, Strauss, Hauer & Feld, L.L.P.

(57) ABSTRACT

A sensing edge for actuating a device to cause a closing door to stop closing upon a force being applied to the sensing edge. The door has a sensing edge surface, which includes an elongated sheath positioned adjacent to the leading edge surface of the door and is compressible upon application of an external force. Within the sheath is a cavity where a sensor is positioned which is responsive to an external force applied to the sheath. A closure is positioned proximate an end of the sheath. The closure has a channel in an outer surface which extends the width of the closure. The closure further includes a passageway therethrough extending from the cavity to the channel. At least one electrical conductor, which extends through the passageway and partially through the channel to one of the front and rear sides, is in electrical communication with the sensor.

12 Claims, 2 Drawing Sheets

UNIVERSAL SENSING EDGE WITH NON-MELT END CLOSURE

BACKGROUND OF THE INVENTION

The present invention relates to sensing edges for automatic doors and, more particularly, to bilateral sensing edges which can be readily mounted on either side of the door.

Sensing edges for doors are generally well known. Such sensing edges generally include an elongate sheath in which a force sensing switch (sensor) is positioned. Upon the application of an undesired force to the sheath, the sensor actuates suitable control circuitry for controlling movement of the door. The sensor, positioned within the sheath, typically comprises a pair of flexible, electrically conductive sheets positioned on the upper and lower sides of a layer of non-conducting loam having a plurality of openings extending therethrough from the upper to the lower side. Upon application of force to the sheets, either or both of the conductive sheets are deflected into electrically conductive engagement with each other through the openings in the layer of foam, to thereby actuate suitable control circuitry for controlling the door.

The typical sensing edge includes conductors attached to the sensor for transmitting the sensing signal to appropriate control circuitry mounted to one side or the other of the door external to the sensing edge. In a typical sensing edge, the conductors exit the sheath of the sensing edge through an aperture that is located at the end surface of the sheath or on the top edge or side of the sheath.

It is very desirable for the conductors to exit from the inside of the sensor edge in order that the conductors be less susceptible to damage and to avoid interference with the door operation. However, a conventional sensing edge that employs an inside exit for the conductor requires the manufacture of both right hand and left hand versions of the sensing edge in order to properly place the conductors going to the control circuitry located on the inside of the door for both right and left handed door control circuitry installations. An additional problem may arise if an installer goes to a job site and, in the middle of an installation, discovers that for some reason the control circuitry must be located on a different side of the door than was originally planned. He must then leave the job site to exchange the sensing edge that is currently in his possession, for another sensing edge which has the conductors placed on the other side of the sensor edge.

The present invention is directed to a sensing edge for a door for sensing objects that come into contact with the sensing edge during door closing that is compatible with both right and left hand door control circuitry installations. The sensing edge in the present invention overcomes the problems inherent in the prior art by providing a means for routing the conductors to either the front side or the back side of the sensing edge after the sensing edge is completely fabricated. Although this technology is generally well known in the field, previous bilateral sensing edges require the use of a filling material to be melted into the end of the sensing edge in order to lock the conductors in place and seal the sensing edge so as to prevent damage from moisture, contaminants, and the like. The end of the sensing edge of the present invention merely requires an adhesive with which to maintain the conductors in place, allowing for easier installation than previous bilateral sensing edges. Thus, installation or changes to an installation can be made in the field by the installer without the use of tools such as a hot plate. A single model of the present sensing edge can be used for both left handed and right handed door installations, thereby eliminating the need for manufacturers to produce and stock multiple models of each sensing edge. The result is that only one item need be manufactured for both left and right handed door installations and the installer need only take a single sensing edge to the job site with the assurance that the job requirements can be satisfied, even if the installation parameters change during the installation. The ability to route the conductors to either the front side or the back side of the sensing edge makes the sensing edge bilateral.

BRIEF SUMMARY OF THE INVENTION

Briefly stated, the present invention is directed to a sensing edge for actuating a device to cause a closing door having a sensing edge surface to stop closing upon a force being applied to the sensing edge. The sensing edge includes an elongated sheath positioned adjacent to the leading edge surface of the door, the sheath being compressible upon the application of an external force. The sheath forms a cavity having opposing front and rear sides and first and second oppositely disposed ends. A sensor is positioned within the cavity. The sensor is responsive to an external force applied to the sheath between the first and second ends. A closure is positioned proximate one of the first and second ends of the sheath. The closure has an outer surface facing opposite the cavity and front and rear sides corresponding to the front and rear sides of the sheath. The closure has a channel extending from the outer surface toward the cavity to a depth into the closure. The channel extends a length between the front and rear sides of the closure. The closure further includes a passageway extending therethrough from the cavity to the channel. At least one electrical conductor is in electrical communication with the sensor and extends through the passageway and partially through the channel to one of the front and rear sides.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Certain terminology is used in the following description for convenience only and is not limiting. The words "right", "left", "upper", and "lower" designate directions to the drawings to which reference is made. The words "inwardly" and "outwardly" refer to directions toward and away from, respectively, the geometric center of the sensing edge and designated parts thereof. The terminology includes the words both specifically mentioned, derivatives thereof, and words of similar import.

Figure 1:
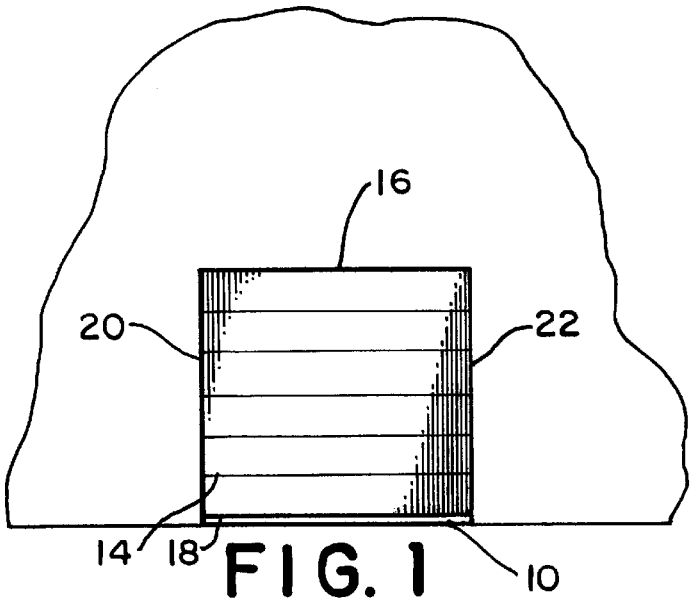
FIG. 1 is a front elevational view showing a door construction including a sensing edge in accordance with a preferred embodiment of the present invention.

Referring to the drawings in detail, wherein like numerals indicate like elements throughout, there is shown at FIGS. 1 through 4 the first preferred embodiment of a sensing edge 10 for actuating a control device 12 to cause a closing door 14 to stop closing upon a force being applied to the sensing edge 10, in accordance with the present invention. There is shown in FIG. 1 a doorway 16 provided with the door 14. While the door 14 as illustrated, is an overhead door having a sensing edge 10 in accordance with the present invention along its lower side or leading edge surface 18, it is within the scope and spirit of the invention to incorporate the sensing edge 10 along the, edge of any door structure, such as vertically disposed or horizontally movable doors (not shown) as desired. Moreover, it is understood that those skilled in the art that the sensing edge 10 is not limited to use in connection with only doors, it can be used for other application, such as automatic windows and gates.

The door 14 has a leading edge surface 18, a first lateral side surface 20 and a second lateral side surface 22. The first lateral side surface 20 and second lateral side surface 22 extend generally parallel with respect to each other, and are oppositely disposed. The door 14 is generally movable mounted on a track (not shown) which guides the door 14 through a range of motion. While the door 14 is indicated to be mounted on a track, it is understood by those skilled in the art that other means of mounting the door 14 in a doorway 16 could be employed, including hinges and levers, without departing from the spirit and scope of the invention.

Figure 2:
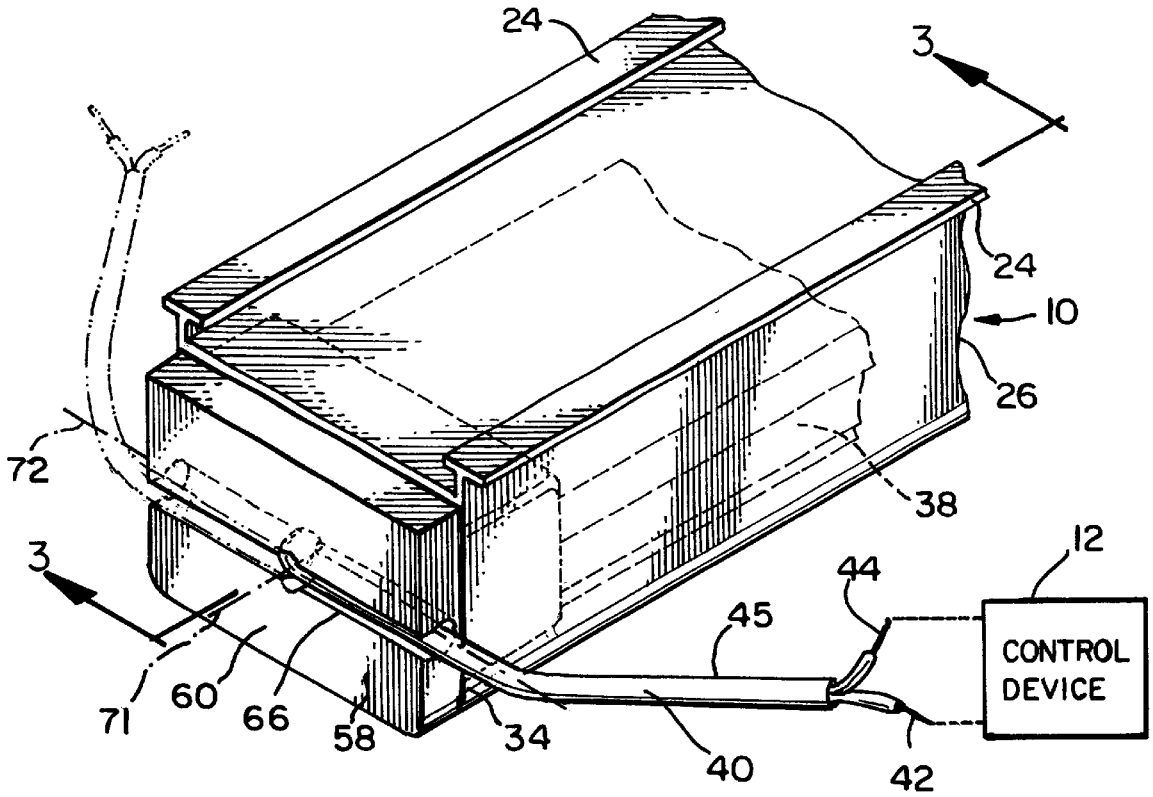
FIG. 2 is an enlarged partial perspective view of a first end of the sensing edge showing the closure and a portion of the sensing edge in phantom.

Referring now to FIG. 2, the sensing edge 10 includes a securing means for fixing or attaching the sensing edge 10 adjacent to the leading edge surface 18 of the door 14. In the embodiment shown, the sensing edge 10 is secured to the door 14 via a pair of spaced securing members 24, which are T-shaped in the end view and extend outwardly from the sensing edge 10 and into suitably complimentary shaped slots (not shown) in the leading edge surface 18 of the door 14. Note that the sensing edge 10 may also be secured to the door 14 in any other suitable manner. For instance, the sensing edge 10 may be secured by a single member (not shown) which extends outwardly from the sensing edge 10 and into a suitably sized groove (not shown) in the leading edge of the door 14 and may be secured in the groove by use of a friction fit, adhesive substance, mechanical fasteners, or any other conventional securing means. Moreover, it is also within the spirit and scope of the invention to secure the sensing edge 10 to the leading edge surface of the door 14 by an adhesive (not shown) applied between the leading edge surface 18 and the upper peripheral face of the sensing edge 10.

Figure 3:
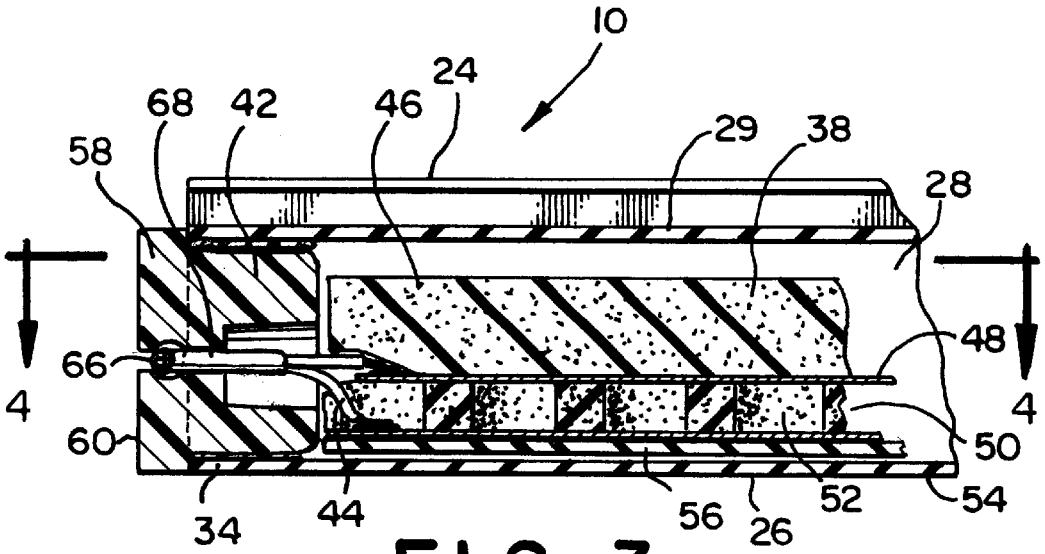
FIG. 3 is a partial cross-sectional elevational view of the sensing edge taken along line 3—3 in FIG. 2.
Figure 4:
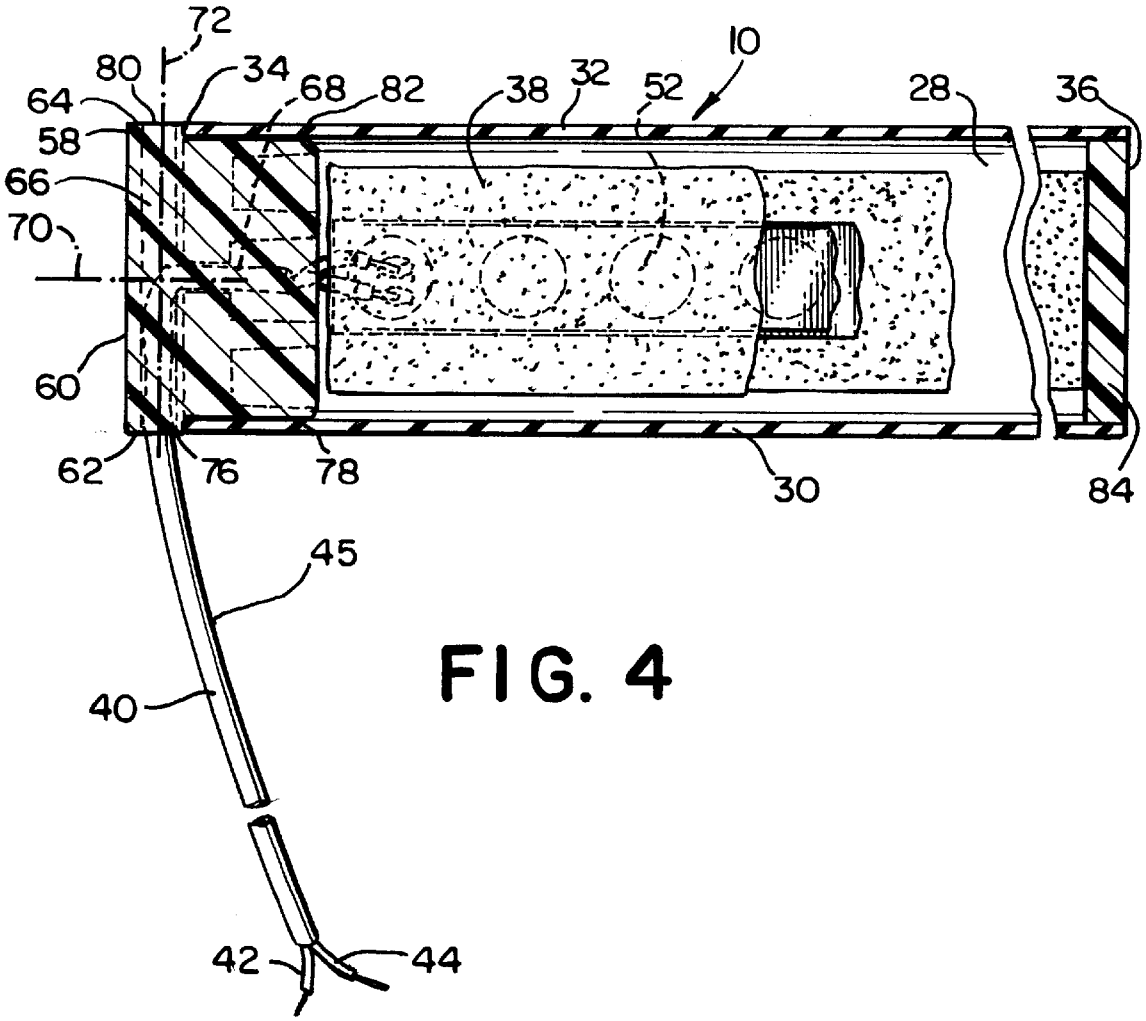
FIG. 4 is a partial cross-sectional plan view of the sensing edge taken along line 4—4 of FIG. 3.

Referring now to FIGS. 3 and 4, the sensing edge 10 is comprised of an elongate sheath 26 extending outwardly or downwardly from the securing member 24 and forming a cavity 28, which is compressible upon application of an external force. In the present embodiment, it is preferred that the sheath 26 be advantageously fabricated of a form-retaining but flexible material, such as rubber. However, it is understood by those skilled in the art, that the sheath 26 can be made of any form-retaining flexible material, such as an elastomeric material. It is preferred that the sheath 26 have a generally constant cross-sectional outline, extending closely along the leading edge surface 18 of the door 14. In the present embodiment, the sheath 26 is generally of rectangular cross-section, but may be of any other suitable shape, such as circular or semi-circular (not shown).

Referring now to FIG. 4, the sheath 26 has a first open end 34 and a second oppositely disposed open end 36, a front side 30 and a rear side 32. The sensing edge 10 is secured to the leading edge surface 18 of the door 14 using the securing members 24 such that the first end 34 and the first side surface 20 of the door 14 are generally coplanar and the second end 36 and the second side surface 22 of the door 14 are also generally coplanar.

Referring now to FIGS. 3 and 4, a sensor 38 is positioned within the cavity 28. The sensor 38 is responsive to an external force applied to the sheath 26 substantially between the first and second ends 34, 36. In the first preferred embodiment, the sensor 38 extends substantially the entire length of the sensing edge 10. More particularly, the sensor 38 comprises a first sheet of resiliently compressible material 46 which is positioned within the sheath 26 and includes a first face and a second face. The first face of the first sheet of resiliently compressible material 46 is in engagement or corresponding facing relationship with the top interior side 29 of the sheath 26. In the first preferred embodiment, the first sheet of resiliently compressible material 46 and succeeding layers and sheets, described hereinafter, are generally sized to compliment the internal configuration of the sheath 26. However, it is understood by those skilled in the art, that the first sheet of resiliently compressible material 46 and succeeding layers and sheets can be sized to be as wide or as narrow as desired, and be virtually of any length for accommodating different structures and uses.

In the first preferred embodiment, the first sheet of resiliently compressible material 46 is constructed of an electrically insulating material, preferably soft foam rubber. However, it is understood by those skilled in the art, that the first sheet of resiliently compressible material 46 can be constructed of either closed or open cell foam rubber or of other electrically insulating materials having similar properties.

Just below (when viewing FIG. 3) the first sheet of resiliently compressible material 46 is a first sheet of flexible, electrically conductive material 48, engaged therewith, and having a first and a second face. The first face of the first sheet of flexible, electrically conductive material 48 is in engagement or in corresponding facing relationship with the second face of the first sheet of resiliently compressible material 46.

In the first preferred embodiment, the first sheet of flexible, electrically conductive material 48 is generally thin and preferably constructed of aluminum or aluminum foil. However, it is within the spirit and scope of the invention to construct the first sheet of flexible, electrically conductive material 48 of other materials, such as copper, brass, or the like.

The first sheet of flexible, electrically conductive material 48 is in engagement with a layer of non-conductive material 50 having a first face and a second face for spacing apart the first sheet of flexible electrically conductive material 48 and a second sheet of flexible electrically conductive material 54, described hereinafter. The first face of the layer of non-conductive material 50 is engagement or corresponding facing relationship with the second face of the first sheet of flexible, electrically conductive material 48.

The layer of non-conductive material 50 has at least one opening 52 extending therethrough between the first and second faces thereof. As shown in FIGS. 3 and 4, the layer of non-conductive material 50 preferably includes a plurality of spaced openings 52 interspersed along the entire length thereof for allowing the actuation of the sensor 38 by applying pressure thereto and causing the electrically conductive material layers 48, 54 to make electrical contact. In the present embodiment, it is preferred that the openings 52 be generally be oval-shaped in cross-section. However, it is in the spirit and scope of the invention to configure the openings 52 of any geometric shape, such as square or circular.

The layer of non-conductive material 50 is preferably constructed of soft foam rubber. It is understood by those skilled in the art, that the layer of non-conductive material 50 can be constructed of either closed or open cell foam or other material having similar insulating properties so long as the function of the sensor 38 is achieved.

The layer of non-conductive material 50 is in engagement with a second sheet of flexible, electrically conductive material 54 having a first face and a second face. The first face of the second sheet of flexible, electrically conductive material 54 is in engagement or in corresponding facing relationship with the second face of the layer of non-conductive material 50.

In the present embodiment, it is preferred that the second sheet of flexible, electrically conductive material 54 be constructed of the same material in the same configuration as the first sheet of flexible, electrically conductive material 48.

In engagement with the second sheet of flexible, electrically conductive material 54 is a second sheet of resiliently compressible material 56 having a first face and a second face. The first face of the second sheet of resiliently compressible material 56 is in engagement or corresponding facing relationship with the second face of the second sheet of flexible, electrically conductive material 54. The second sheet of resiliently compressible material 56 is preferably constructed of the same material and configured generally identically to the first sheet of resiliently compressible material 46, except that it has a lesser thickness. However, it is apparent to those skilled in the art, that the first and second sheets of resiliently compressible material 46, 56, can differ in configuration, size, and/or material.

Referring to FIGS. 3 and 4, at least one electrical conductor 40 is in electrical communication with the sensor 38 for connection with a circuit (not shown) that forms part of the control device 12 for controlling the actuation of the door 14 when the sensor 38 detects the application of force to the sheath 26. Such control devices 12 are well known to those of ordinary skill in the art, accordingly further description thereof is omitted for purposes of brevity and convenience only and is not limiting. In the first preferred embodiment, the electrical conductor 40 is comprised of first and second electrical conductors or wire 42, 44 enclosed in a casing 45 and electrically connected to the first and second sheets 48, 54 of the sensor 38, respectively, preferably by soldering at one end thereof. However, it is understood that the first and second electrical conductors 42, 44 can be connected to the first and second electrically conductive sheets 48, 54 by any suitable means, such as welding, crimping, or a fastener.

In the first preferred embodiment, shown in FIGS. 3 and 4, a closure 58 is positioned partially within the cavity 28 proximate to either the first end 34 or the second end 36 of the sheath 26. The closure 58, which is the same as or slightly greater than the size of the cavity, sealingly engages the internal surface of the sheath 26 to provide a fluid-impervious barrier so that the sensor 38 is protected from outside elements such as water and other liquid or solid material. The closure 58 has an outer surface 60 facing opposite the cavity 28 and front and rear sides 62, 64 facing respectively the front and back sides 30, 32 of the sheath 26.

The closure 58 includes a channel 66 extending from the outer surface 60 toward the cavity 28 to a predetermined depth into the closure 58. The channel 66 extends the entire length between the front and rear sides 62, 64 of the closure 58. The channel 66 is open along its entire length to the outer surface 60 of the closure 58. In the present embodiment, it is preferred that the channel 66 be located along the center of the closure 58 perpendicular to both the front and rear sides 62, 64 of the closure 58. However, it is in the spirit and scope of the invention to configure the channel 66 in any direction, such as diagonally up, diagonally down, v-shaped, and vertical.

The closure 58 also includes a passageway 68 that extends along a first axis 70 which is substantially co-linear with a longitudinal axis of the cavity 28 and substantially perpendicular to a second axis 72 of the channel 66. The passageway 68 has a circular cross-section. The passageway 68 extends along the first axis 70 through the closure 58 from the cavity 28 to the channel 66. The passageway 68 intersects the channel 66 at an intersection point along the length of the channel 66. The passageway 68 continues through the channel 66 at the intersection point, opening to the outer surface 60 of the closure 58 with a circular cross-section. In the present embodiment, it is preferred that the intersection point of the passageway 68 and the channel 66 is approximately at the center of the closure 58, corresponding to the center point of the channel 66. However, it is within the spirit and scope of the invention for the passageway 68 to intersect the channel 66 at any point along the length of the channel 66.

The conductor 40 extends through the passageway 68 from the cavity 28 to the channel 66, along which the conductor 40 can then be routed to one of the outer, front, and rear surfaces 60, 62, 64 of the closure 58. It is preferred that the conductor 40 extends from the sensor 38, through the passageway 68, out from the outer surface 60 of the closure 58, and through one of the sides of the channel 66 in order to exit the closure 58 from one of the front and rear sides 62, 64. After choosing an appropriate side of the closure 58 from which the conductor 40 is to exit and routing the conductor 40 along the appropriate side of the channel 66, the conductor 40 can then be sealed within the channel 66 using an adhesive 74.

Because the channel 66 is open to both the front and rear sides 62, 64 of the closure 58, as well as being open along its entire length to the outer surface 60 of the closure, the conductor 40 may exit the sheath 26 from any one of the front or rear sides 62, 64 of the closure 58 or the outer surface 60 of the closure 58. Therefore, the sensing edge 10 may be installed on the door 14 with the closure 58 proximate to either the first or second side surfaces of the door 20, 22, thereby making the sensing edge 10 bilateral.

The channel 66 has a pear-shaped cross-section, allowing the conductor 40 to be retained in a recessed manner within the channel 66 and under the outer surface 60 of the closure 58. This allows the conductor 40 to be extended from its electrical connection with the sensor 38, through the passageway 68, and through part of the channel 66, exiting from one of the front and rear sides 62, 64 of the closure 58, while being held in a recessed manner under the outer surface of the closure 58. Retention of the conductor 40 within the channel 66 is achieved because the width of the channel 66 at the outer surface 60 is less than the diameter of the conductor 40. However, it is understood that the shape of the cross-section of the channel 66 can take the form of any other suitable shape in which the conductor 40 can be routed in a recessed manner, such as a frusto-triangular cross-section.

The closure 58 is fabricated of one piece that includes front and rear sides 62, 64. The front side 62 includes a first front surface 76 and a second front surface 78, and the rear side 64 includes a first rear surface 80 and a second rear surface 82. The first front surface 76 and the first rear surface 80 are a first distance apart, and the second front surface 78 and the second rear surface 82 are a second distance apart. The first distance is greater than the second distance, giving the closure 58 a step like appearance such that the closure 58 can be partially inserted within either the first or second ends 34, 36 of the sheath 26. The second distance is the same as or slightly greater than the width of the cavity 28 to provide a tight fit. The channel 66 is housed within the portion of the closure 58 that remains protruding outside the sheath 26. This configuration allows the channel 66 to be accessible from the outer surface 60, the front side 62, and the rear side 64 of the closure 58. However, it is within the spirit and scope of the invention to configure the closure 58 in a shape other than the step like shape described above. The closure 58 could also take the form of a plug with a uniform width that would be inserted completely within one of the first and second ends 34, 36 of the sheath 26, necessitating the presence of holes in the sheath 26 so that the channel 66 is accessible from both the front and rear sides 62, 64 of the closure 58.

The stopping block 84, sealingly engaging the sheath 26, is positioned proximate to the other of the first and second ends 34, 36 of the sheath 26. The stopping block 84, in combination with the closure 58, prevents the weight of the door from activating the sensor 38 when the door makes contact with an intended surface such as the ground or door frame (not shown). In order not to interfere with the operation of the sensor 38, the closure 58 and the stopping block 84 are positioned at the first and second ends 34, 36 of the sheath 26 such that they remain outside the sensing range of the sensor. It is generally preferred that the closure 58 and the stopping block 84 be constructed of polyvinyl chloride (PVC). However, it is appreciated by those skilled in the art that the closure 58 and the stopping block 84 may be constructed of any substantially non-compressible substance, such as hardened rubber, stiffened plastic, or synthetic resin.

The sensing edge 10 may be manufactured for any particular installation with or without knowledge of which side of the door 14 the control device 12 will be mounted. Assuming no knowledge of which side of the door 14 of the control device 12 will be mounted, the manufacturing assembly steps would comprise: (1) threading one end of the conductor 40 through the passageway 68 of the closure 58; (2) cutting the sheath 26 and the sensor 38 to length depending upon the specific door 14 dimensions; (3) stripping the conductor wires 42, 44 of the conductor 40 and attaching the wires 42, 44 to the first and second sheets of the electrical conductors 48, 54 of the sensor 38; (4) inserting the stopping block 84 into the sheath and sealing the stopping block 84 to the sheath 26; (5) inserting the sensor 38 and closure 58 into the sheath 26; and (6) sealing the closure 58 to the sheath 26. At this point in the assembly of the sensing edge 10, the conductor 40 extends out from the outer surface 60 of the closure 58 and sensing edge 10 is ready for installation. Completion of the sensing edge 10 assembly is performed following attachment to the door 14, at which time the conductor 40 is routed partially through the channel 66 such that the conductor 40 exits the closure 58 from one of the front, rear, and outer surfaces 62, 64, 60 of the closure 58, depending on whether the control device 12 is on the left or the right hand side of the door 14. Following the routing of the conductor 40 partially through the channel 66, the conductor 40 is held in place within the channel 66 and passageway 68 using the adhesive 74 to prevent the entrance of moisture into the sensing edge 10. The conductor 40 is electrically connected to the control device 12.

Assuming the sensing edge 10 is manufactured with knowledge of which side of the door 14 the control device 12 will be mounted, then the routing and sealing steps described in the preceding paragraph can be carried out at the manufacturing site instead of the installation site.

The order in which the foregoing steps of assembly of the sensing edge 10 is not pertinent to the present invention. That is, it is understood by those of ordinary skill in the art from this disclosure that the order of the steps of assembly can be varied without departing from the spirit and scope of the invention. For instance, selecting and cutting the length of the sheath 26 and sensor 38 could be the first step in the assembly process.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A sensing edge for actuating a device to cause a closing door to stop closing upon a force being applied to the sensing edge, the door having a leading edge surface, the sensing edge comprising:

an elongate sheath positioned adjacent to the leading edge surface of the door and being compressible upon application of an external force, the sheath forming a cavity and having opposing front and rear sides and first and second oppositely disposed ends;

a sensor positioned within the cavity, the sensor being responsive to an external force applied to the sheath between the first and second ends;

a closure positioned proximate one of the first and second ends of the sheath, the closure having an outer surface facing opposite the cavity and front and rear sides corresponding to the front and rear sides of the sheath, the closure having a channel extending from the outer surface toward the cavity to a depth into the closure, the channel being open to the outer surface and extending along an entire length of the outer surface between the front and rear sides of the closure, the closure further including a passageway therethrough extending from the cavity to the channel; and at least one electrical conductor in electrical communication with the sensor, the conductor extending through the passageway and partially through the channel to one of the front and rear sides.

2. The sensing edge as recited in claim 1, wherein the closure is fabricated of a single piece of material.

3. The sensing edge as recited in claim 2, wherein the closure includes front and rear sides, the front side including a first front surface and a second front surface and the rear side including a first rear surface and a second rear surface, such that the first front surface and the first rear surface spaced a first distance apart and the second front surface and the second rear surface spaced a second distance apart, said first distance being greater than said second distance, such that a first portion of the closure of a first width corresponding to said second distance fits within one of the first and second sheath ends and the second portion of the closure of a second width corresponding to said first distance remains protruding outside of the sheath.

4. The sensing edge as recited in claim 1, wherein the passageway has a first axis extending substantially colinear with a longitudinal axis of the cavity, and the channel has a second axis extending substantially perpendicular to the first axis.

5. The sensing edge as recited in claim 1, wherein the closure is made of a substantially non-compressible material, the closure, in combination with a stopping block positioned proximate to the other of the first and second ends of the sheath preventing the sensor from being responsive to an external force when the sensing edge makes contact with only an intended surface.

6. The sensing edge as recited in claim 1, wherein the closure is sealed to the sheath.

7. The sensing edge as recited in claim 1, wherein the electrical conductor is maintained within the channel using an adhesive.

8. The sensing edge as recited in claim 1, wherein the conductor exits from the closure at the inner surface and the outer surface through the passageway of the closure, the conductor then being capable of being routed partly through the channel to one of the front and rear sides of the closure such that the sensing edge is bilateral.

9. The sensing edge as recited in claim 1, wherein the passageway has a circular cross-section.

10. The sensing edge as recited in claim 1, wherein the passageway intersects the channel at an intersection point along the length of the channel, the passageway continuing through the channel at the intersection point and forming an opening to the outer surface of the closure, the opening having a circular cross-section.

11. A sensing edge for actuating a device to cause a closing door to stop closing upon a force being applied to the sensing edge, the door having a leading edge surface, the sensing edge comprising:

an elongate sheath positioned adjacent to the leading edge surface of the door and being compressible upon application of an external force, the sheath forming a cavity and having opposing front and rear sides and first and second oppositely disposed ends;

a sensor positioned within the cavity, the sensor being responsive to an external force applied to the sheath between the first and second ends;

a closure positioned proximate one of the first and second ends of the sheath, the closure having an outer surface facing opposite the cavity and front and rear sides corresponding to the front and rear sides of the sheath, the closure having a channel that extends from the outer surface toward the cavity to a depth into the closure, the channel being open to the outer surface of the closure, the channel further extending a length between the front and rear sides of the closure, the closure including a passageway therethrough extending from the cavity to the channel; and at least one electrical conductor in electrical communication with the sensor, the conductor extending through the passageway and partially through the channel to one of the front and rear sides.

12. A sensing edge for actuating a device to cause a closing door to stop closing upon a force being applied to the sensing edge, the door having a leading edge surface, the sensing edge comprising:

an elongate sheath positioned adjacent to the leading edge surface of the door and being compressible upon application of an external force, the sheath forming a cavity and having opposing front and rear sides and first and second oppositely disposed ends;

a sensor positioned within the cavity, the sensor being responsive to an external force applied to the sheath between the first and second ends;

a closure positioned proximate one of the first and second ends of the sheath, the closure having an outer surface facing opposite the cavity and front and rear sides corresponding to the front and rear sides of the sheath, the closure having a channel that is open through the outer surface of the closure along a channel length, the channel extends from the outer surface toward the cavity to a depth into the closure, the channel length extending between the front and rear sides of the closure, the closure further including a passageway therethrough extending from the cavity to the channel; and at least one electrical conductor in electrical communication with the sensor, the conductor extending through the passageway and partially through the channel to one of the front and rear sides, a width of the channel at the outer surface of the closure is less than a diameter of the conductor.

* * * * *